US007445498B2

(12) United States Patent
Tsuo

(10) Patent No.: US 7,445,498 B2
(45) Date of Patent: Nov. 4, 2008

(54) FIXED SEAT OF A SOCKET

(75) Inventor: Chun-Jung Tsuo, Taoyuan Hsien (TW)

(73) Assignees: BENQ Corporation (TW); QISDA Corporation (TW)

( * ) Notice: Subject to any disclaimer, the term of this patent is extended or adjusted under 35 U.S.C. 154(b) by 0 days.

(21) Appl. No.: 11/527,310

(22) Filed: Sep. 26, 2006

(65) Prior Publication Data

US 2007/0093126 A1 Apr. 26, 2007

(30) Foreign Application Priority Data

Oct. 24, 2005 (TW) ..... 94137183 A

(51) Int. Cl.
*H01R 13/73* (2006.01)

(52) U.S. Cl. ..... 439/562

(58) Field of Classification Search ..... 439/562–565
See application file for complete search history.

(56) References Cited

U.S. PATENT DOCUMENTS 5,622,511 A * 4/1997 Jarrett ..... 439/248
6,875,052 B1 * 4/2005 Lo et al. ..... 439/564
6,921,292 B2 * 7/2005 Miyazaki ..... 439/564
7,059,882 B2 * 6/2006 Sugita et al. ..... 439/247

FOREIGN PATENT DOCUMENTS

JP 2004-127522 4/2004

OTHER PUBLICATIONS

English Abstract of JP 2004-127522 dated Apr. 22, 2004.

* cited by examiner

*Primary Examiner*—Truc T Nguyen
(74) *Attorney, Agent, or Firm*—Ladas & Parry LLP

(57) ABSTRACT

A socket having a flange is applied to a display device. The display device has a side plate further having a combining hole to mount the socket. When the socket is mounted inside the combining hole, the flange of the socket sticks the side plate around the combining hole and a clamp plate for clamping the side plate at the combining hole is placed on top of the socket. By providing the flange of the socket and the clamp plate, the socket can be firmly restricted at the combining hole.

17 Claims, 12 Drawing Sheets

FIXED SEAT OF A SOCKET

FIELD OF THE INVENTION

The present invention relates to a socket structure, more particularly to the socket having a clamp plate to avoid possible cracks of the printed circuit board (PCB) caused by unexpected movement of the plug inside the socket.

BACKGROUND OF THE INVENTION

Recently, 3C products (communication, computer and consumer electronics) have already played important roles in daily life. In particular, the new emerging flat panel display that features less space occupation has quickly grasped people's attention and interests and is extending its market share over the traditional cathode ray tube displays.

In the flat panel display industry, the liquid crystal display (LCD) is one of the well-developed products. The LCD has merits of lightweight, convenient moving and less space occupation and is widely applied to cell phones, language translators, digital cameras, PDAs and notebook computers.

Referring to FIGS. 1*a*~1*c*, a perspective back view of a conventional LCD, an exploded view of a conventional socket structure of the LCD, and an exploded view of another socket structure for the LCD of FIG. 1*a* are shown, respectively. The flat panel display generally includes a panel display 101, a PCB 110 and other related elements. The PCB 110 is connected to the panel display 101 for driving the panel display 101 to show the image. In general, to protect the PCB 110, a housing (not shown in the figure) of the PCB 110 can be introduced to contain the PCB 110.

A side plate lateral to the PCB 110 (may be a part of the housing of the PCB) can provide a plurality of holes to mount relevant sockets for the LCD. In FIG. 1*a*, three holes are respectively shown to mount a power socket 11, and two digital sockets 12 and 13. In particular, the hole at the right hand side of the plate in FIG. 1*a* is a power socket 11 to receiving a power plug 14.

Referring to FIG. 1*b*, an exploded view of the power socket 11 of FIG. 1*a* is shown. One end of the power socket 11 has pins for connecting to the PCB 110, while the opposing end thereof has a socket hole 111 for receiving the plug 14. Another side of the socket 11 has a plurality of welds 1102 to pair respectively a plurality of pads 1103 on the PCB 110. By wielding each weld 1102 and the corresponding pad 1103, the socket 11 can be fixed and electricity connected to the PCB 110.

To further fix the power socket 11 on the PCB 110, a fixed iron piece 112 is used to restrain the socket 11 by screwing to the PCB 110 through the combining holes 1130 at the opposing extending portions 113 of the fixed iron piece 112.

As shown in FIG. 1*b*, a side plate 15 of the PCB 110 has a hole 150 to expose the socket 11 of the PCB 110. When the PCB 110 is mounted in the housing, the socket 11 can just be accessible through the hole 150.

Therefore, when the plug 14 engages with the socket 11, the welding between the socket 11 and the PCB 110 needs to sustain a substantial pulling force from the plug's action. In some accidental situations, the pulling force may be large enough to crack the welding between the socket 11 and the PCB 110 that may finally lead to fail the connection to the power source and the imaging of the flat panel display. Further, for the extend portion 113 of the fixed iron piece 112 is fixed firmly on the PCB 110, a room on the PCB 110 must be empty, and thus wasted, to dodge the fixed iron piece 112.

Referring to FIG. 1*c*, an exploded view of another conventional socket 21 is shown. An end of the socket 21 has pins connected to the PCB 210. One side of the socket 21 has a socket hole 211 for receiving the plug (not shown in the figure). A bottom face of the socket 21 has a plurality of welds 2102 to pair a plurality of corresponding pads 2103 of the PCB 210. Through the welding, the socket 21 can then be fixed and electrically connected to the PCB 210.

For ensuring the socket 21 on the PCB 210, a conventional back-housing 26 of the panel display is used to press on top of the socket 21. As shown in FIG. 1*c*, a plurality of ribs 260 (two shown in the figure) are extended downward to clamp firmly the socket 21.

The side plate 25 of the housing of the PCB can provide a plurality of combining holes to expose the socket 21 of the PCB 210. As shown in FIG. 1*c*, the upper portion of the side plate 25 has combining holes 250. When the PCB 210 is mounted inside the housing 10, the socket 11 can receive a plug through the combining holes 150. In a typical pulling out process of an engaging plug, the retrieval force for pulling out the plug is regarded as a harmful shearing force against the welds between the socket 21 and the PCB 210.

In addition, with respect to the retrieval force through the plug, the direction arrangement of the ribs is not good for structural stability. In particular, the socket may fall off from the housing after frequently usage. Besides, when the plug is anchored inside the socket, the welding between the socket and the PCB needs to sustain the disturbance force from the plug. So, any accidental force upon the socket or the plug may be easily to crack the welding between the socket and the PCB. Definitely, any crack to the welding may interrupt the power source to the flat panel display.

SUMMARY OF THE INVENTION

The object of the present invention is to provide a fixed seat of the socket firmly holding the socket on the PCB so as to avoid the pulling force of the plug to crack the PCB.

The another object of the present invention is to provide a flat panel display having the fixed seat of the socket, and the fixed seat can avoid any movement between the socket and the PCB pulling out of the plug.

The fixed seat of the socket of the present invention is applied to a panel display device. One side face of the socket has a flange. The fixed seat comprises a side plate and a clamp plate. The side plate has a combining hole for the socket to receive an external plug. The flange of the socket is fixed onto the side plate of the fixed seat.

In a preferred embodiment, the combining hole is an opening gap and the clamp plate is combined to the combining hole for holding the side plate. In another embodiment, the combining hole is formed as a seal gap.

In a preferred embodiment, an end of the socket having a combining hole to receive a plug, and another end of the socket is electrically connected to a PCB by welds or screws.

In a preferred embodiment, the clamp plate comprises an inner clamp plate and an outer clamp plate spaced from the inner clamp plate so as to clamp the side plate in between. Each side of the combining hole has a trough to engage, by screws or the like, a respective hook of the clamp plate.

In another preferred embodiment, a flat panel display having a fixed seat of a socket comprises a panel display, a PCB, a socket and a fixed seat. The PCB is connected to the panel display. An end of the socket is connected to the PCB, and a side face of the socket has a flange. The fixed seat comprises a side plate and a clamp plate. The side plate has a combining hole, and the clamp plate clips the side plate so as to have the socket fixed on the side plate.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTIONS OF THE PREFERRED EMBODIMENT

The object of the present invention is to provide a fixed seat of the socket for avoiding any relative movement of the socket with respect the side plate while the socket meets a pull-out or push-in of an external plug.

The fixed seat applicable to the flat panel display or other display device is set to a side plate of the corresponding display device so as to protect welds between the socket and the PCB from being cracked by applications upon the plug.

Figure 1A:
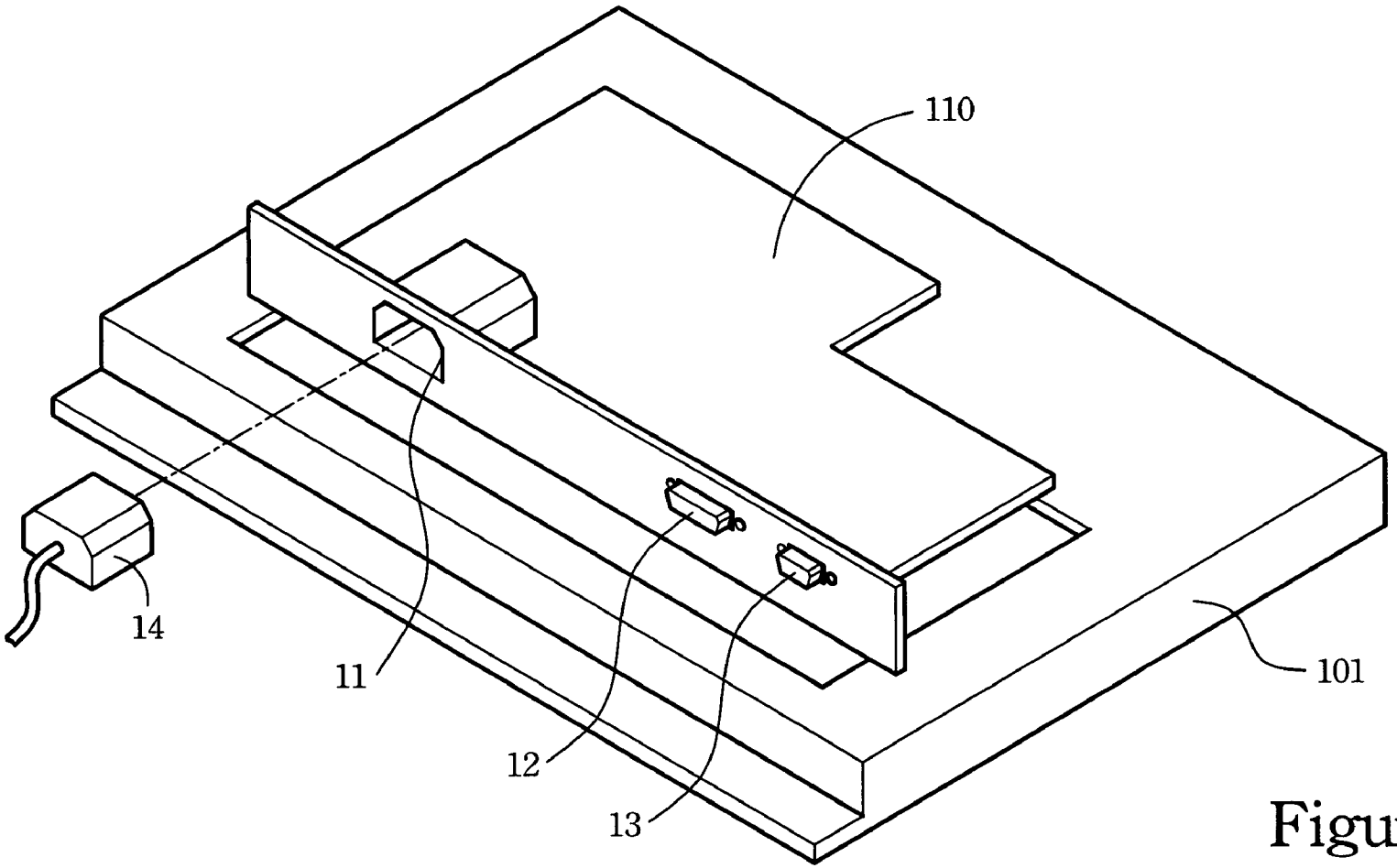
Figure 1a (Prior Art)
FIG. 1*a* is a perspective view of a back of a conventional flat panel display.
Figure 1B:
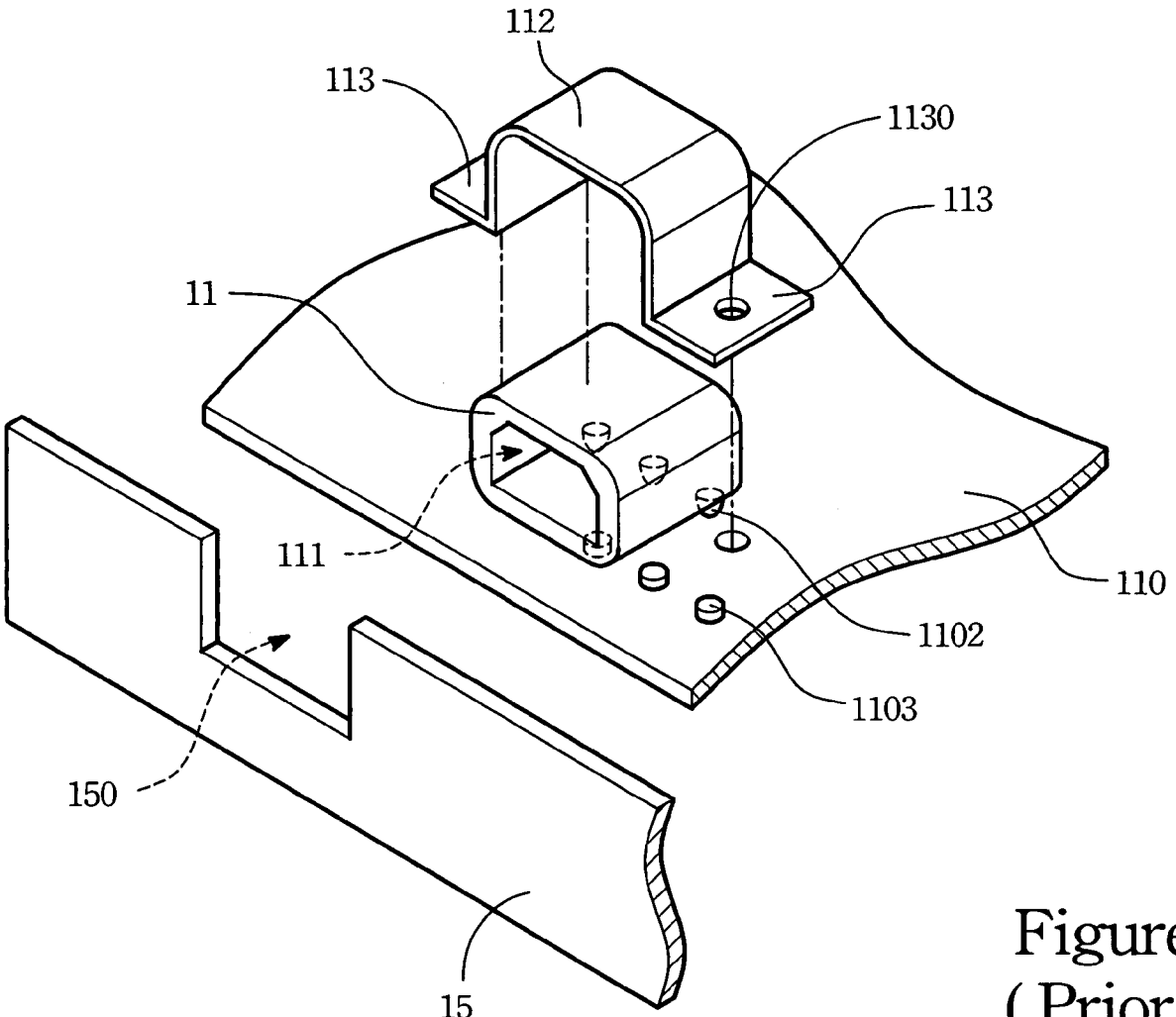
Figure 1b (Prior Art)
FIG. 1*b* is an exploded view of a conventional socket for FIG. 1*a;*
Figure 1C:
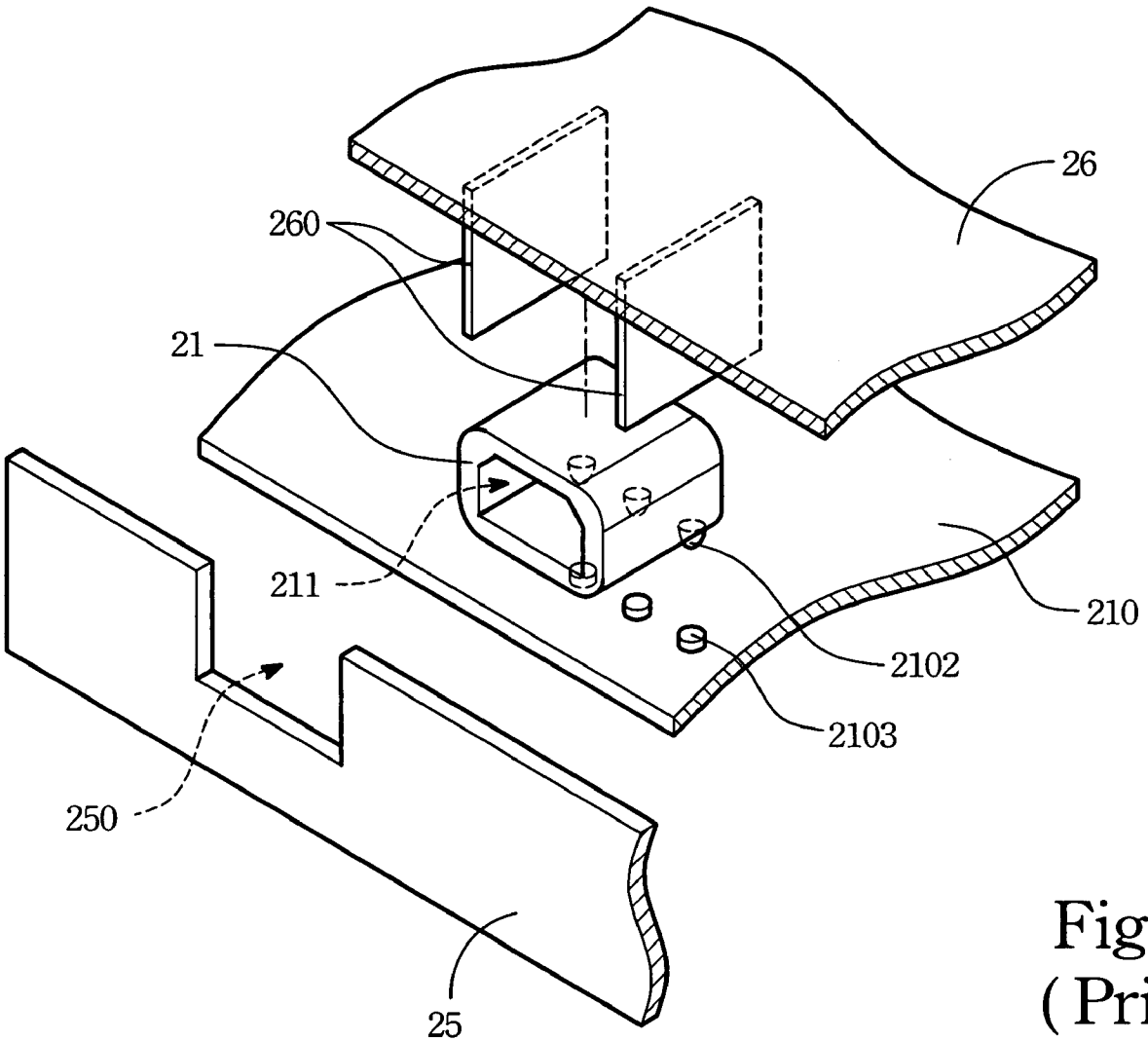
Figure 1c (Prior Art)
FIG. 1*c* is an exploded view of another conventional socket.
Figure 2:
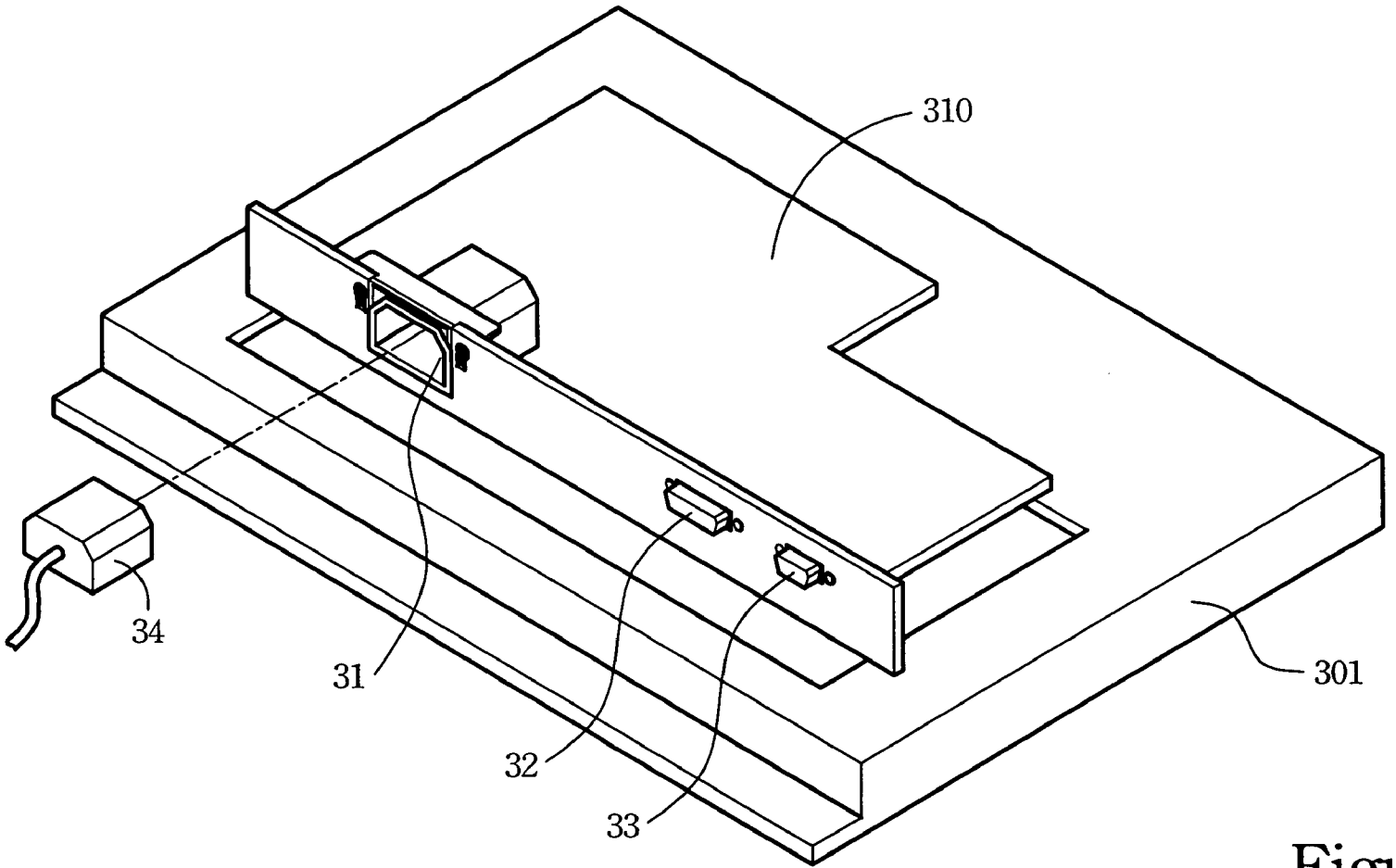
FIG. 2 is a perspective view of a preferred flat panel display having a socket of the present invention.

Referring now to FIG. 2, a flat panel display having a fixed seat of a socket in accordance with the present invention is shown. The flat panel display includes a panel display 301, a PCB 310 and other related elements. The PCB 310 is mounted to a back of the panel display 301, so as to drive the panel display 301. Also, to protect the PCB 310, a housing (not shown in the figure) for the PCB 310 can be included in the flat panel display.

A side plate 351 of the housing for the PCB 310 has a plurality of combining holes 352 to mount or expose various sockets or plugs connected with the PCB 310. In FIG. 2, three combining holes 352 are shown to mount a power socket 31 and two digital sockets 32 and 33, respectively. In particular, the combining hole 352 at the left hand side of FIG. 2 is used to expose the socket for receiving an external power plug 34.

Referring now to FIGS. 3*a~f*, various illustrations are used to demonstrate a preferred embodiment of the flat panel display having a fixed seat of the socket of the present invention. In the present invention, the fixed seat of the socket mainly comprises a socket 31, a side plate 351, and a clamp plate 36.

An end of the socket 31 is connected to the PCB 310, and one side of the socket 31 has a socket hole 311 for receiving the plug 34. A bottom face of the socket 31 has a plurality of welding 3102 to pair respectively a plurality of pads of the PCB 310 (not shown in the figure). The socket 31 is fixed and thus electrically connected to the PCB 310 by welding. In addition, the socket 31 can be further surely fixed onto the PCB 310 by screwing.

Figure 3A:
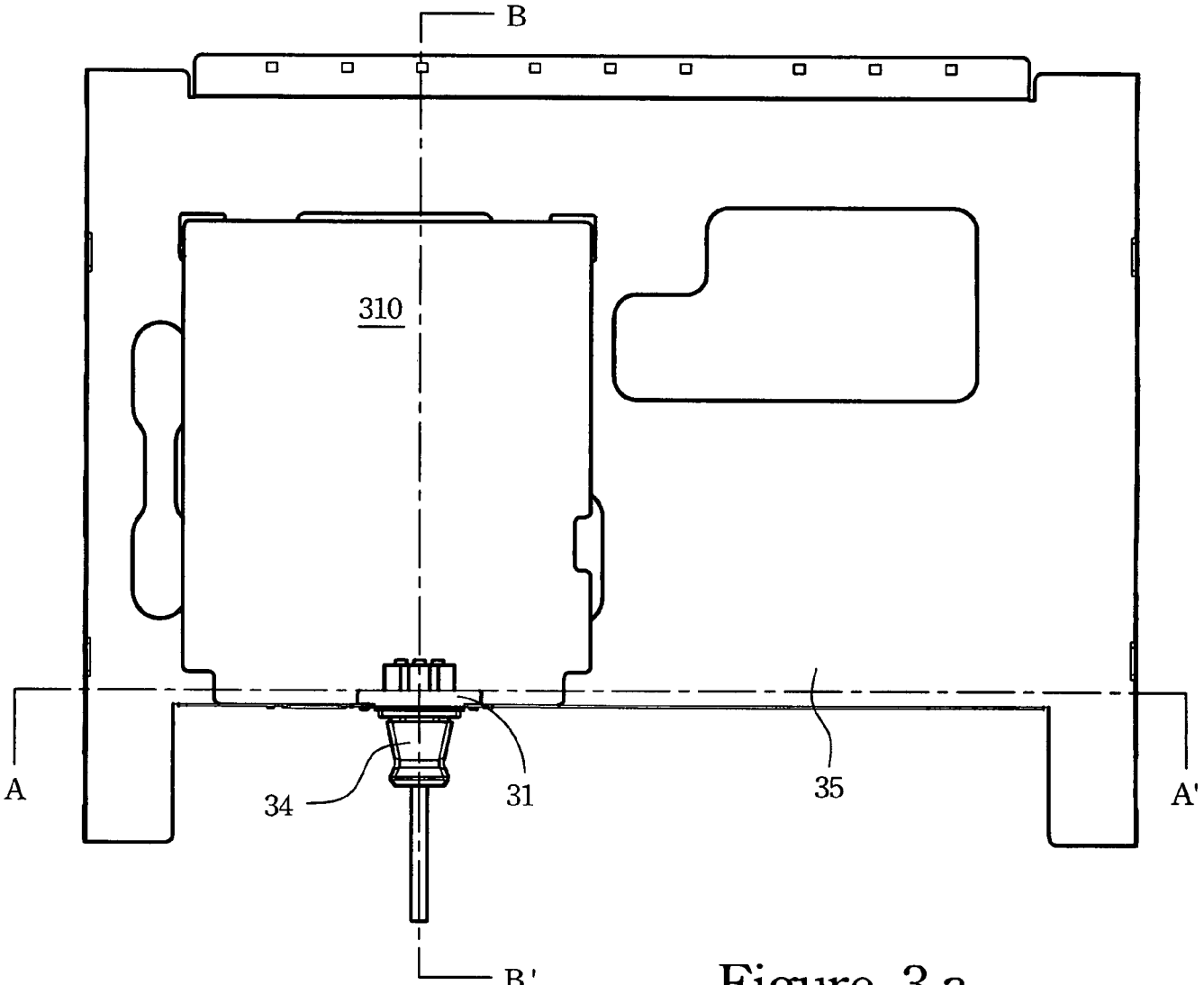
FIG. 3*a* is a top view of the flat panel display of FIG. 2.
Figure 3B:
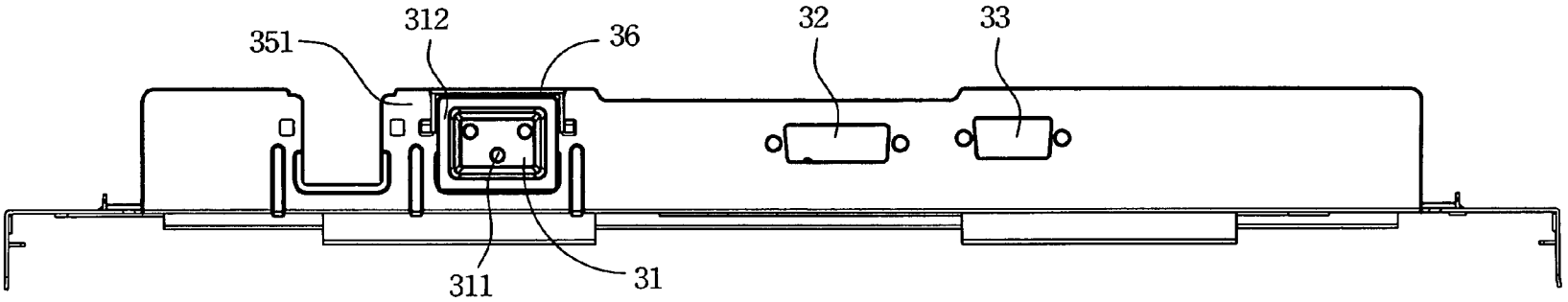
FIG. 3*b* is a cross-sectional view of FIG. 3*a* along line AA'.
Figure 3C:
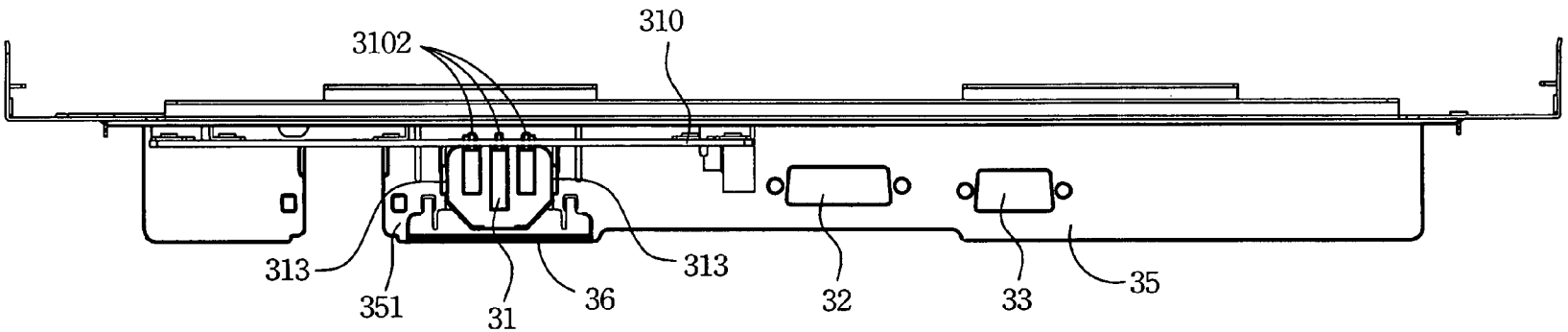
FIG. 3*c* is another cross-sectional view of FIG. 3*a* along lines AA' at an opposite view angle with respect that of FIG. 3*b;*
Figure 3D:
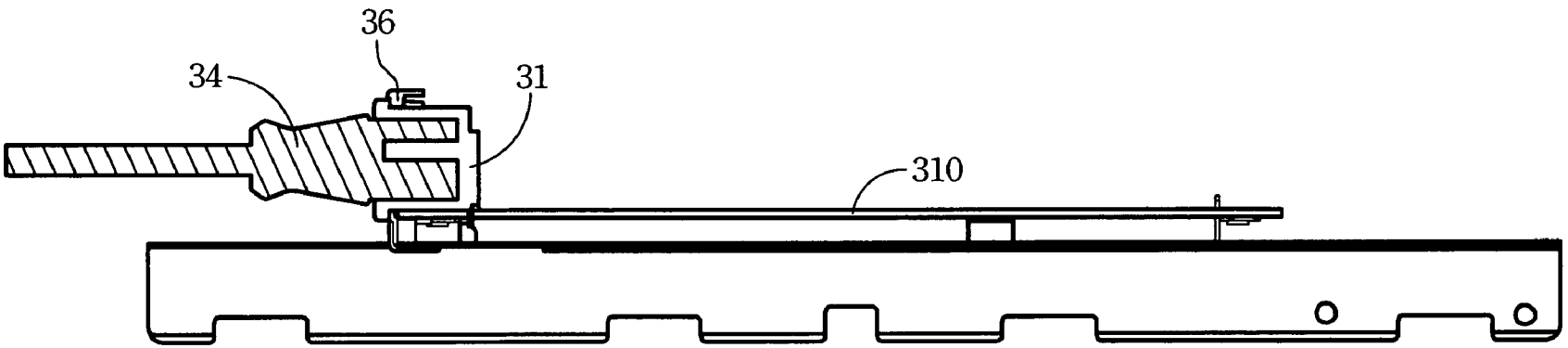
FIG. 3*d* is a cross-sectional view of FIG. 3*a* along line BB'.
Figure 3E:
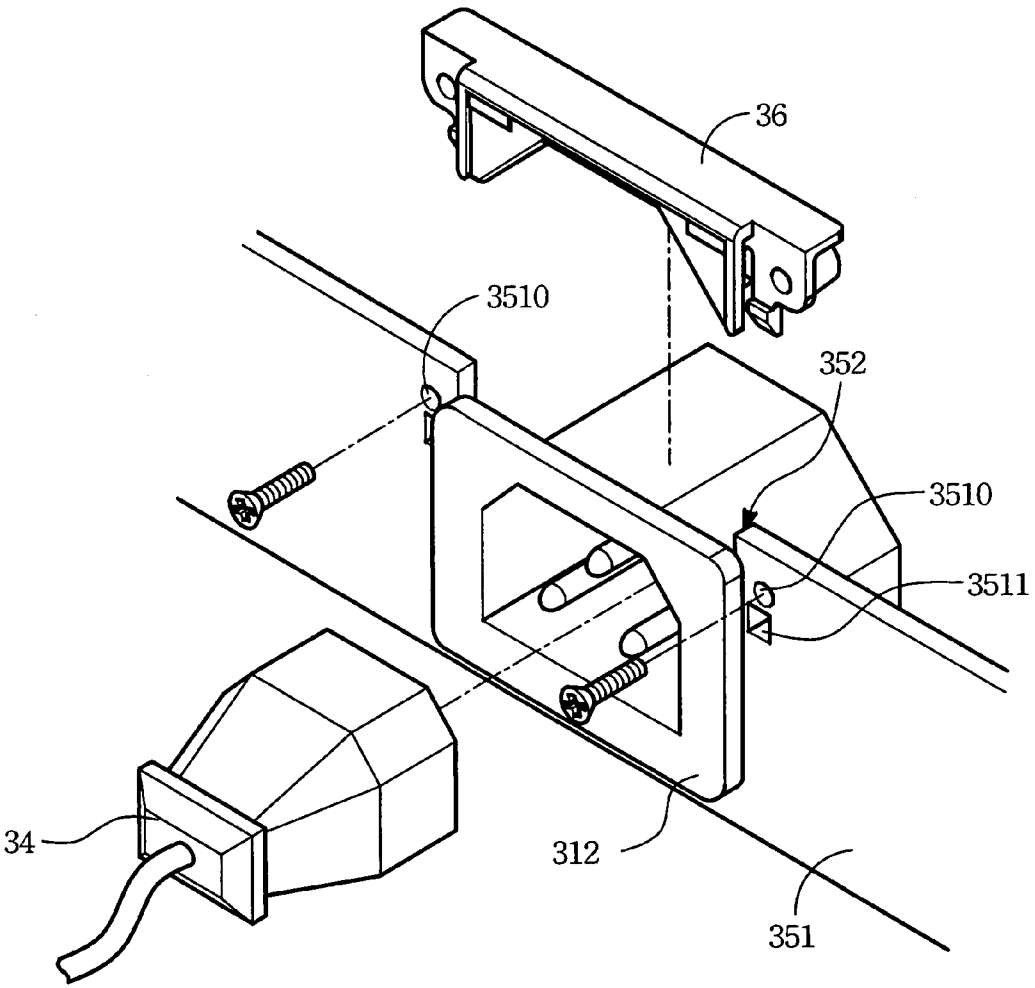
FIG. 3*e* is an exploded view of the socket of FIG. 3*a;*
Figure 3F:
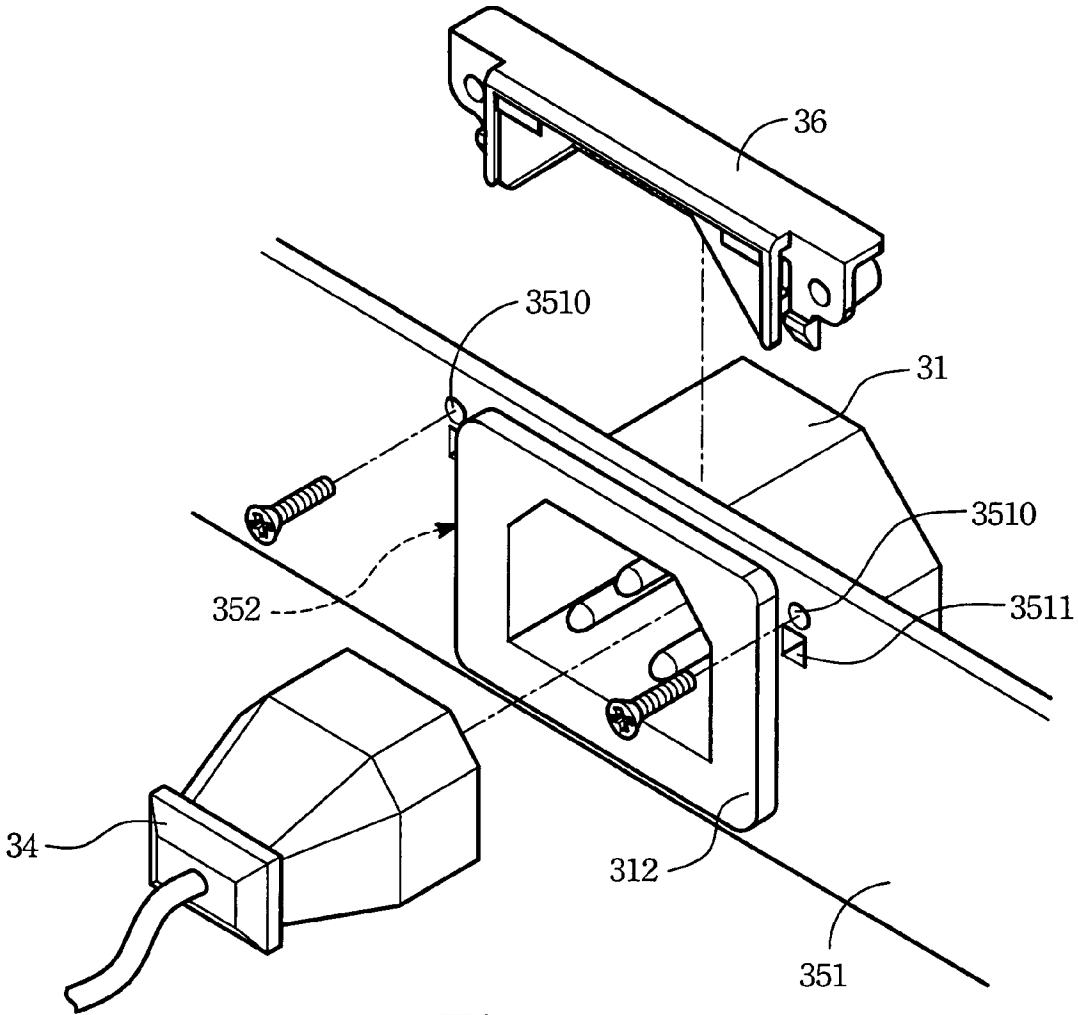
FIG. 3*f* is an exploded view of another preferred embodiment of the socket for the panel display of FIG. 3*a;*

A flange 312 of the socket 31 is included at a side of the socket 31 facing the plug 34. As shown in FIG. 3*e*, the side plate 351 has a combining hole 352 for mounting the socket 31. Preferably, the flange 312 of the socket 31 can be structured to surround the edge of the combining hole 352. Each of the two opposing lateral sides of the socket 31 has a block 313 to act as a stop to help the socket 31 riding through the combining hole 352. When the PCB 310 sets inside the housing 30, a free end portion of the socket 31 protrudes out the combining hole 352 as shown in FIG. 3*e*. As the socket 31 mounted across the combining hole 352, the flange 312 is located at one side of the side plate 351 while the blocks 313 is located at the other side of the side plate 351, such that the socket 31 can be restrained to the side plate 352.

In the preferred embodiment, the combining hole 352 is an opening gap (as shown in FIG. 3*e*), and the clamp plate 36 is to introduced to seal the top open end of the gap 352 so as to fix the socket 31 to the combining hole 352 therein, with also the stop pair formed by the flange 312 and the blocks 313 of the socket 31.

Referring now to FIGS. 4*a*~4*e*, various views of the clamp plate 36 applied to position the socket 31 are shown.

Figure 4A:
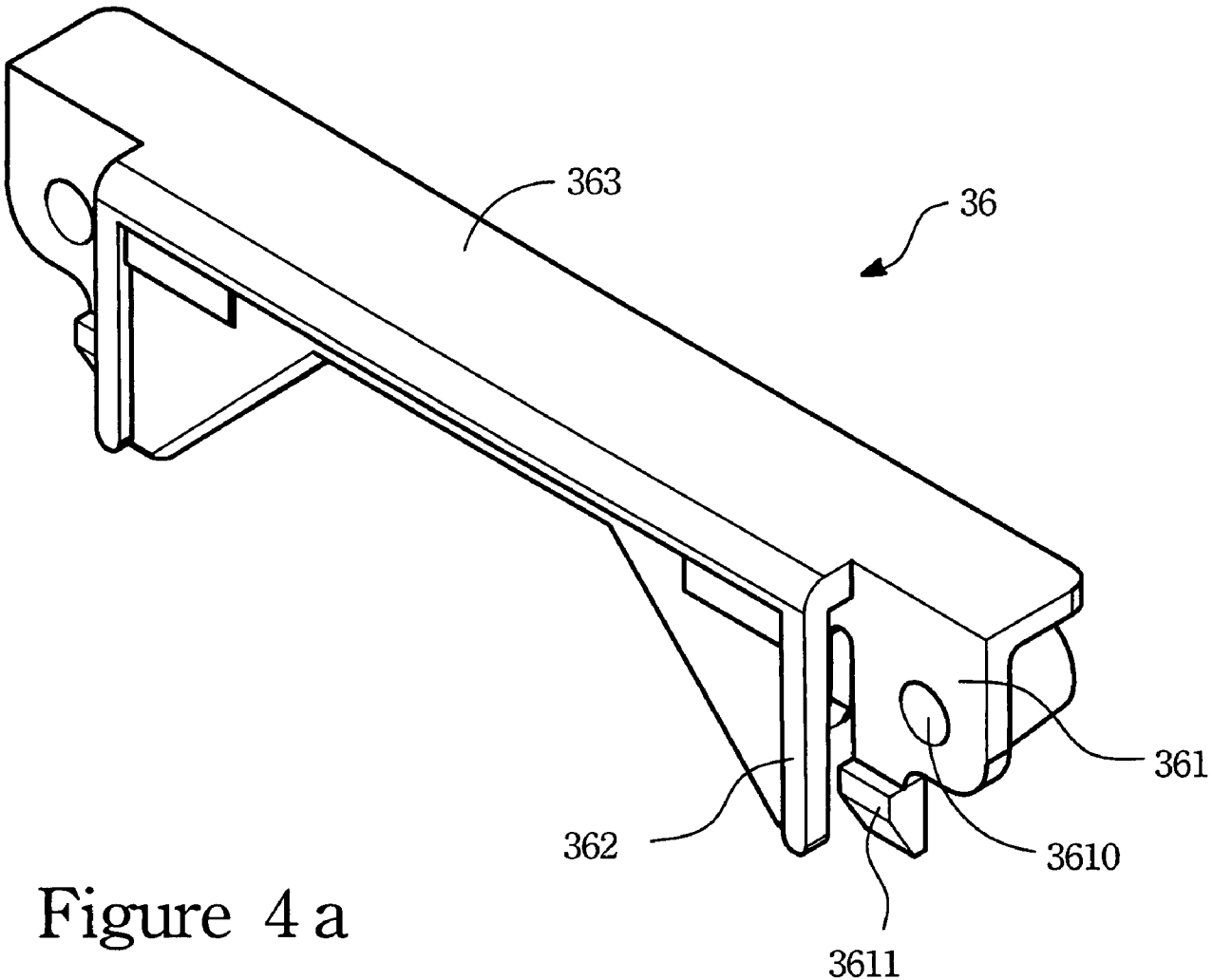
FIG. 4*a* is a perspective view of a preferred clamp plate of the present invention.
Figure 4B:
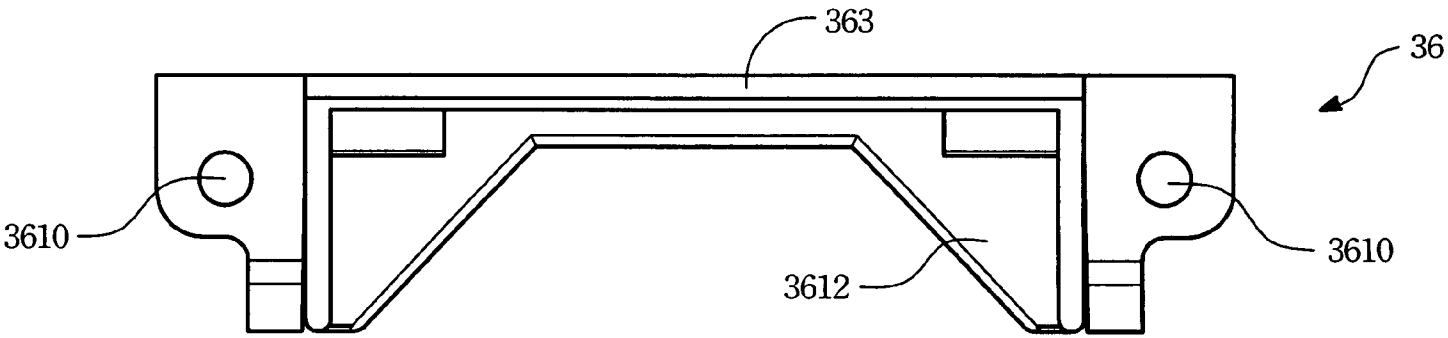
FIG. 4*b* is a front view of the clamp plate of FIG. 4*a;*
Figure 4C:
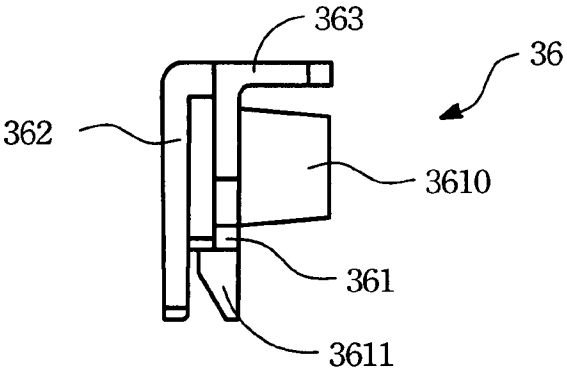
FIG. 4*c* is a lateral side view of the clamp plate of FIG. 4*a;*
Figure 4E:
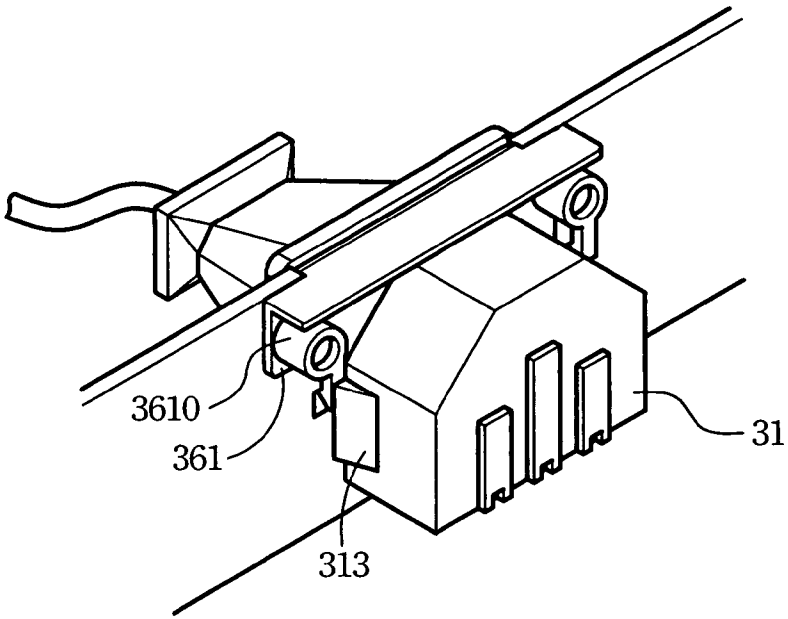
FIG. 4*e* is another perspective view of FIG. 4*d.*
Figure 4D:
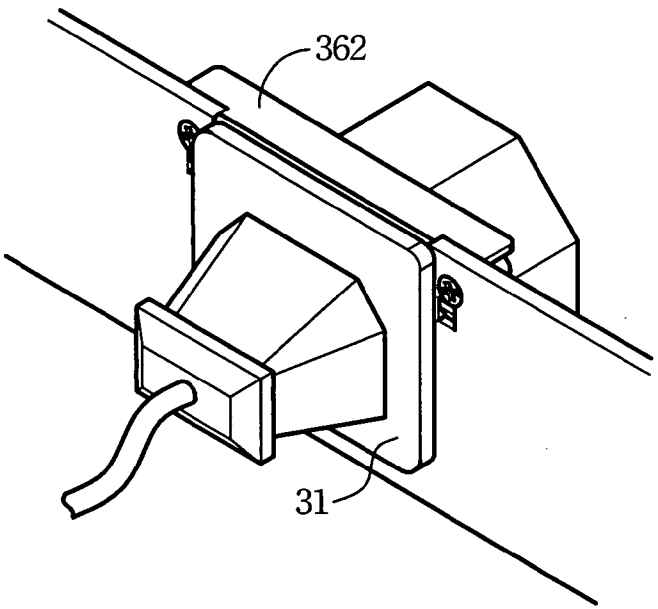
FIG. 4*d* is a perspective view of the clamp plate fixed with the socket of the present invention.

The clamp plate 36 of the present invention comprises an inner clamp plate 361 and an outer clamp plate 362. By providing the spacing between the inner clamp plate 361 and the outer clamp plate 362 as clearly shown in FIG. 4*c*, the clamp plate 36 can easily engage with the side plate 351 as shown in FIG. 4*d*. The outer clamp plate 362 can be a ⊓shape for covering top portion of the flange 312. The inner clamp plate 361 sticking onto the inner surface of the side plate 351 has screw holes 3610 at the two end portions thereof for corresponding to the screw-holes of the side plate 351 (as shown in FIG. 3*e*). Through the aforesaid screw-holes, relevant screws or bolts can be used to firmly engage the clamp plate 36 and the side plate 351. A trough 3511 of the side plate 351 is located adjacent to the screw-holes of the side plate 351 (as shown in FIG. 4*e*), and the inner clamp plate 361 of the clamp plate 36 has a respective hook 3611 (FIG. 4*c*) to engage the trough 3511. The inner clamp plate 361 further comprises an assist clamp plate 3612 bridging the two ends of the clamp plate 36. The assist clamp plate 3612 must match the socket 31 to cover and hold both firmly.

In this preferred embodiment, the top of clamp plate 36 further comprises an extended face 363 which is perpendicular to both the inner clamp plate 361 and the outer clamp plate 362. The extended face 363 extends horizontally to act as a part to integrate the clamp plate 35 to the panel display. The clamp plate 36 can be made of a plastics or an iron material.

By providing the fixed seat of the socket in accordance with the present invention, drawbacks of the conventional technology in cracking the PCB and the bottom welding of the socket have been improved. With the introduction of the clamp plate in the present invention, the side plate and the socket can be firmly engaged, and the force from removing the plug can be fully taken by the side plate without being transmitted further to crack possibly the PCB.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A fixed seat of a socket, comprising:

a side plate, having a combining hole to therethrough mount the socket and one trough adjacent to the combining hole;

an inner clamp plate, mounted on top of the combining hole so as to firmly restrict the socket with the combining hole of the side plate and the inner clamp plate, further having a hook to engage respectively with the trough, and an outer clamp plate for the side plate to be clamped between the inner clamp and the outer clamp plate.

2. The fixed seat of the socket of claim 1, wherein said combining hole is an open gap and the inner clamp plate seals the combining hole by engaging the side plate.

3. The fixed seat of the socket of claim 1, wherein said combining hole is a seal gap.

4. The fixed seat of the socket of claim 1, wherein a side of the socket has a flange for contacting the side plate around the edge of the combining hole.

5. The fixed seat of the socket of claim 1, wherein said side of the socket has a hole to receive a plug.

6. The fixed seat of the socket of claim 1, wherein said side plate and the inner clamp plate are further combined by screws.

7. A fixed seat of a socket, comprising:

a side plate, having a combining hole to therethrough mount the socket and a trough adjacent to the combining hole; and a clamp plate, mounted on top of the combining hole so as to firmly restrict the socket with the combining hole of the side plate and the clamp plate, further having a respective hook to engage with the trough, and an inner clamp plate and an outer clamp plate to clamp the side plate in between.

8. The fixed seat of the socket of claim 7, wherein said combining hole is an open gap and the clamp plate seals the combining hole by engaging the side plate.

9. The fixed seat of the socket of claim 7, wherein said combining hole is a seal gap.

10. The fixed seat of the socket of claim 7, wherein a side of the socket has a flange for contacting the side plate around the edge of the combining hole.

11. The fixed seat of the socket of claim 7, wherein said side of the socket has a hole to receive a plug.

12. The fixed seat of the socket of claim 7, wherein said side plate and the clamp plate are further combined by screws.

13. A fixed seat of a socket, comprising:

a side plate, having a combining hole to therethrough mount the socket and a trough adjacent to the combining hole; and a clamp plate, mounted on top of the combining hole so as to firmly restrict the socket with the combining hole of the side plate and the clamp plate, further having a respective hook to engage with the trough;

wherein the side plate and the clamp plate are further combined by screws.

14. The fixed seat of the socket of claim 13, wherein said combining hole is an open gap and the clamp plate seals the combining hole by engaging the side plate.

15. The fixed seat of the socket of claim 13, wherein said combining hole is a seal gap.

16. The fixed seat of the socket of claim 13, wherein a side of the socket has a flange for contacting the side plate around the edge of the combining hole.

17. The fixed seat of the socket of claim 13, wherein said side of the socket has a hole to receive a plug.

* * * * *